United States Patent [19]

Fleming

[11] 4,193,524

[45] Mar. 18, 1980

[54] DISPENSING DEVICE WITH TWO-WAY FLOW CHARACTERISTIC AND HALF TWIST CLOSURE

[76] Inventor: Thomas W. Fleming, 1623 Manning Ave., Los Angeles, Calif. 90024

[21] Appl. No.: 886,051

[22] Filed: Mar. 13, 1978

[51] Int. Cl.[2] ..... B67D 3/04

[52] U.S. Cl. ..... 222/484; 222/521

[58] Field of Search ..... 222/521, 520, 525, 484–485, 222/489, 531, 532, 537, 545–546, 563, 566, 568, 569, 571

[56] References Cited

U.S. PATENT DOCUMENTS

| | | | |
|---|---|---|---|
| 225,298 | 3/1880 | Newton | 222/520 |
| 2,812,120 | 11/1957 | Beall, Jr. | 222/484 X |
| 3,157,323 | 11/1964 | Kitterman | 222/525 X |
| 3,276,640 | 10/1966 | Kessler | 222/546 X |
| 3,294,294 | 12/1966 | Amburgey | 222/525 |

FOREIGN PATENT DOCUMENTS

| | | | |
|---|---|---|---|
| 375521 | 5/1923 | Fed. Rep. of Germany | 222/568 |
| 856544 | 12/1960 | United Kingdom | 222/545 |
| 922188 | 3/1963 | United Kingdom | 222/546 |

*Primary Examiner*—Charles A. Marmor

*Attorney, Agent, or Firm*—Romney, Schaap Golant, Disner & Ashen

[57] ABSTRACT

A dispensing device for use with a variety of containers and contents such as wine and artist's paint. The device has two parts: a stationary member having three flexible flanges for engaging a container and providing a seal, a central disc and a screw thread; and a movable member having a sealing end portion, a measuring throat, a gripping surface and a drip edge. The sealing end portion provides a seal with the disc when the device is in a closed position. The device is simply constructed, reliable and relatively inexpensive.

5 Claims, 8 Drawing Figures

Fig. 7
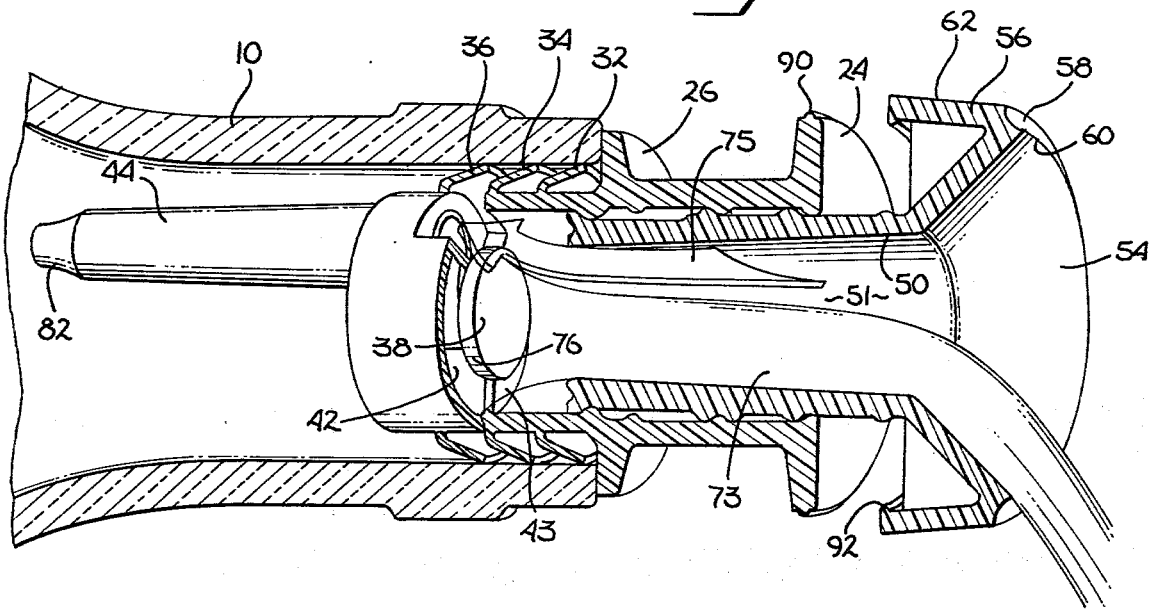
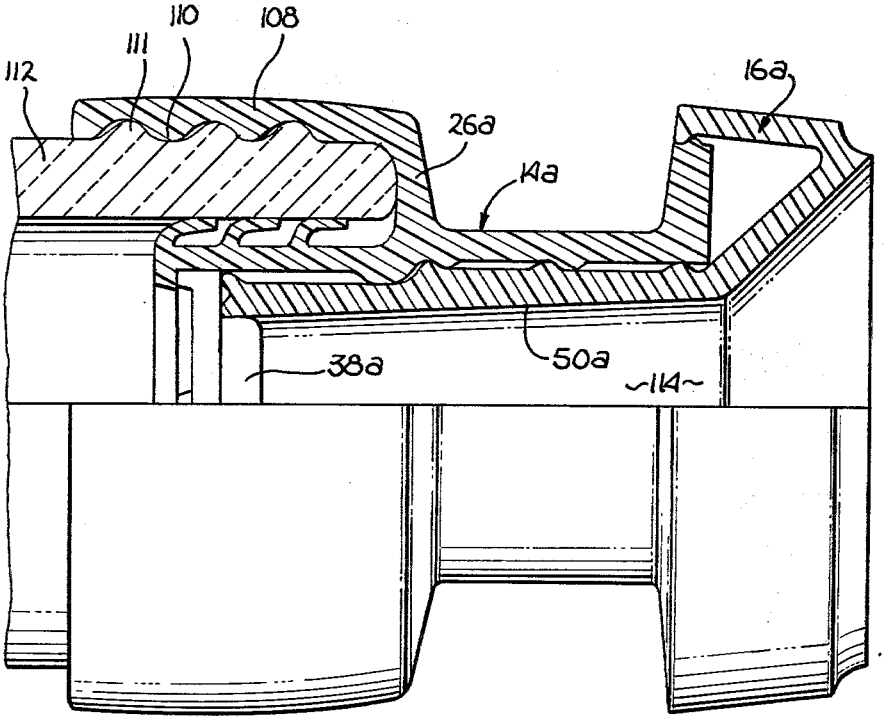
Fig. 8

DISPENSING DEVICE WITH TWO-WAY FLOW CHARACTERISTIC AND HALF TWIST CLOSURE

BACKGROUND OF THE INVENTION

1. Field of the Invention

The present invention relates to a dispensing device and more particularly to a dispensing device for liquids such as wine whereby an effective seal can be maintained even when the bottle is stored in a horizontal position. The device can also be used to dispense other products in an easily metered manner.

2. Description of the Prior Art

The prior art is replete with various dispensing apparatus indicative of a continuing effort by workers in the field to solve difficult problems. For example, a number of U.S. patents have been found extending back more than twenty-five years illustrating prior art efforts.

In spite of this continuing work, problems continue to persist. In most cases prior art dispensers have proven to be overly expensive, ineffective and/or unreliable. In order to compete effectively in the marketplace, it is necessary that a dispenser be commercially priced. Dispensers having a multiple number of parts or having parts which are overly complicated in design will invariably lead to excessive cost. Dispensers must also be leakproof if they are to function in their intended manner. Dispensers for liquids which open and close by virtue of one part sliding over an opening in another part will almost invariably fail to prevent leakage. Still other prior art devices require an irreversible change to be made (i.e., opening a sealed passage) to the dispenser prior to its first use. Such a unit will be reliable so long as this change does not take place; however, once such change does occur, the dispenser becomes operable but unreliable.

SUMMARY OF THE INVENTION

The present invention solves the problems mentioned above in the prior art by providing a dispensing device comprising a first member adapted to be disposed in a passageway of a content carrying container, the member having a generally tubular body with two sections, the first section including internal means for forming a content passageway and a plurality of external relatively flexible flanges; and a second member adapted to cooperatively operate with the first member, the second member having two sections, a first section being generally tubular and having a smooth internal surface, a sealing end surface and an externally extending thread for engaging the internally extending thread of the first member and being movable there along and a second section having a funnel shaped surface contiguous with the smooth internal surface of the first section and an annular leg for forming an operating surface, the second member being movable between a closed position in which the sealing end surface engages the internal passageway forming means for blocking the flow of content, and an opened position whereby the second member is moved along the threads to disengage the sealing end surface and the passageway forming means to allow content flow.

An aim of the present invention is to provide a dispensing device which is inexpensive, simply constructed and reliable. Another aspect of the present invention is to provide a dispensing device which effectively seals with the container to which it is engaged as well as with itself and yet is easily removed from the container for reuse on another container and is easily opened and closed. Still another object of the present invention is to provide a dispensing device which allows for superior variation and smooth flow or facilitated metering depending upon the contents to be dispensed.

The foregoing objects, advantages, features, and results, the present invention, together with various other objects, advantages, features and results thereof which will be evident to those skilled in the art in the light of this disclosure, may be achieved with the exemplary embodiments of the invention described in detail hereinafter and illustrated in the accompanying drawings.

FIG. 7 is a sectional perspective view of the dispensing device in an opened position, mounted to a bottle and diagrammatically illustrating the flow of air and liquid through the dispensing device.

FIG. 8 is a half sectional elevational view illustrating a variation of the dispensing device for use with a content such as artist's paint.

DESCRIPTION OF THE PREFERRED EMBODIMENTS

Figure 1:
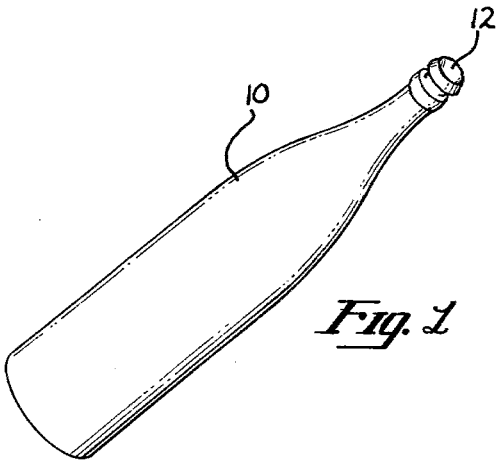
FIG. 1 is a perspective view of a bottle to which the inventive dispensing device is engaged.

While the present invention is susceptible of various modifications and alternative constructions, illustrative embodiments are shown in the drawings and will herein be described in detail. It should be understood, however, that it is not the intention to limit the invention to the particular forms disclosed; but on the contrary the invention is to cover all modifications, equivalences, and alternative constructions falling within the spirit and scope of the invention as expressed in the appended claims.

Referring now to FIG. 1 there is illustrated a container 10 in the form of a wine bottle to which a dispensing device 12 is engaged. It is to be understood that while a wine bottle is illustrated and described any suitable container may be used with the dispensing device. It is also to be understood that the dispensing device is designed to dispense liquids of various viscosity including pasty material such as artist's paint as will be explained in more detail hereinbelow.

The dispensing device 12 is advantageous for a number of reasons: it is inexpensive to manufacture; it is constructed in an uncomplicated manner; and it is highly reliable in use. These advantages are apparent by referring to FIG. 2 which illustrates the dispensing device 12 in detail. The device includes two members, a first stationary member 14 and a second movable member 16. The stationary member in turn may be divided into two sections. The first or upper section includes a tubular body 18 having an interior surface 20. Integral with the tubular body and projecting inwardly from the interior surface is a double screw thread 22. Extending outwardly from the tubular body are two relatively rigid flanges, an upper flange 24 and a lower flange 26.

The second or lower section of the stationary member is integral with the upper section and is merely a continuation of it. For clarity however, the stationary member is divided generally on a functional basis as will become clear from the description. The lower section includes a generally tubular portion 30 from which extend three relatively flexible flanges 32, 34 and 36. Within the interior of the tubular member 30 is a sealing disc 38 which partially blocks passageways such as an air passageway 40 and two liquid (or other content) passageways 42 and 43, FIG. 3. The air passageway includes a tapered air flow tube 44 which extends into the container to which the dispensing device is mounted.

The movable member 16 is also divided into two sections for clarity, a first or lower section and a second or upper section. The lower section includes a slightly converging tubular body 46 having a sealing end portion 48 and a smooth interior surface 50 which forms the boundary of a space or throat 51. About the exterior surface of the tube is a screw thread 52. The second section includes a funnel shape section 53 having a funnel shaped surface 54, an annular leg 56, a connecting concave surface 58 and a drip edge 60. While the funnel shaped section is illustrated as being generally circular it is understood that it can take other shapes; for example, the funnel shaped surface 54 may be elliptical when viewed from above. The annular leg includes an outer surface 62 which may be gripped by an operator for manipulation of the dispensing device. This outer surface 62 may be roughened so as to allow a better grip. It is contemplated that the stationary and movable members will be made of a suitable synthetic resin such as polyethylene or polypropylene. It is further contemplated that the movable member may be molded in one piece while the stationary member may be molded in two pieces depending upon the particular variation of the dispensing device desired.

Another important advantage of the subject dispensing device is its ability to establish an excellent seal between itself and the container into which it is placed. For example, referring to FIGS. 2 and 7 the flexible flanges 32, 34 and 36 are flexed upwardly when inserted into the bottle 10. It has been found that three flanges, each having a thickness of approximately 30 mils (0.003 inches) provide excellent sealing of the container against leakage while at the same time allowing the dispensing device to be easily withdrawn and inserted in another container once the content of the first container has been removed. Additional flanges have been found to make withdrawal of the dispensing device overly difficult while using less than three flanges has been found to provide inadequate sealing. The use of flexible flanges also allows one sized device to be used with many different containers that fall within a size range; it is not necessary that the size of a dispensing device match exactly that of a container. Of course the dispensing device may be made in a wide variety of sizes to fit all sizes of containers.

Figure 2:
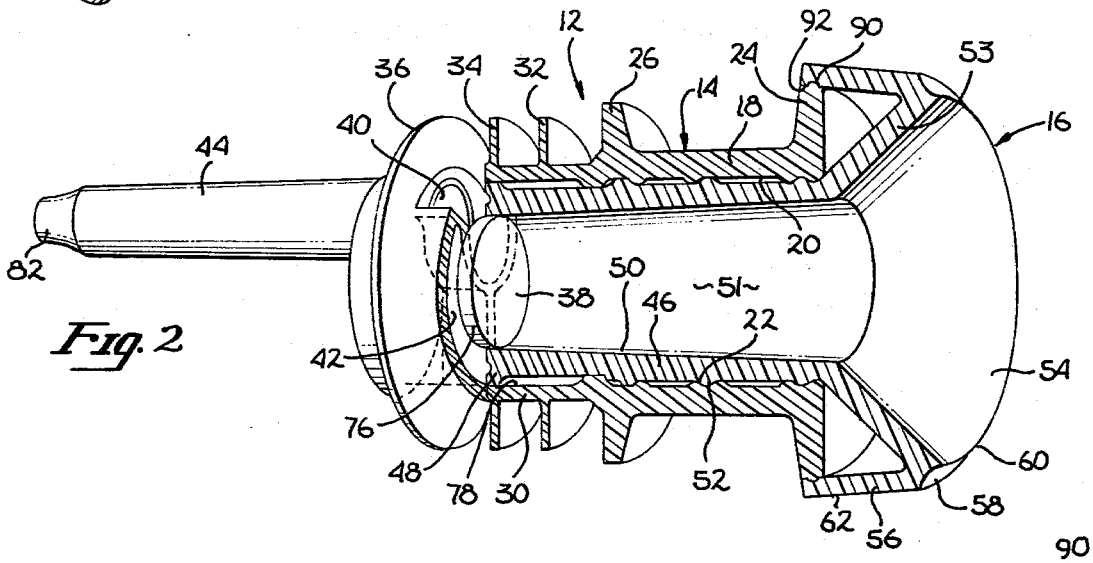
FIG. 2 is a partial sectional perspective view of the dispensing device shown in FIG. 1 in a closed position.
Figure 6:
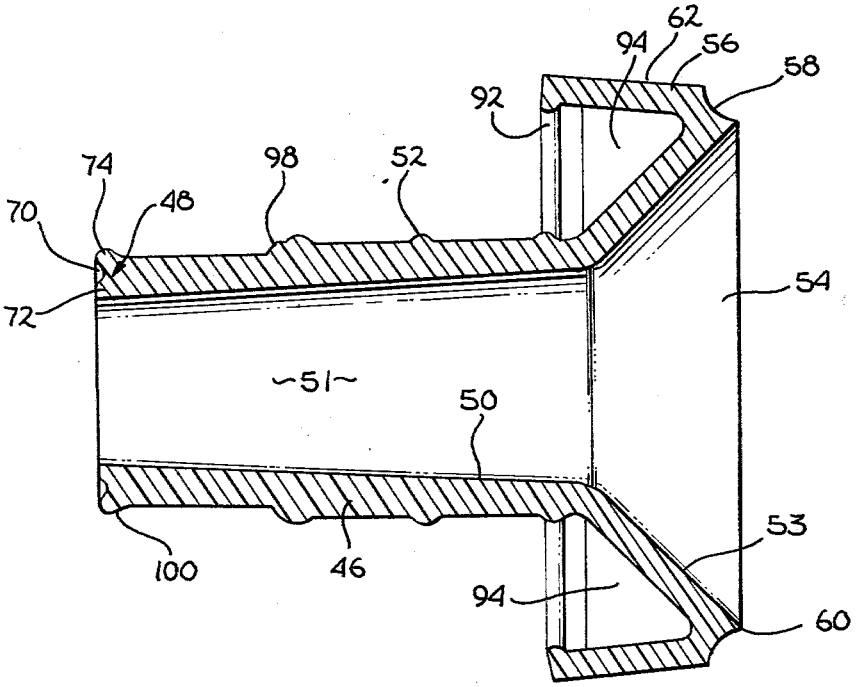
FIG. 6 is a sectional elevation view of the other member of the dispensing device.

Once again, referring to FIGS. 2 and 7, and in addition, FIG. 6, the sealing end portion 48 of the movable member 16 is shown in more detail. As seen in FIG. 6 the end 48 includes an annular recess or depression 70 which forms two legs 72 and 74. As seen in FIG. 7 when the dispensing device is in its opened position, air and content are able to flow through the movable member, around the sealing disc 38 and through the air and content passageways, the content flow being designated by the numeral 73 while the air flow is depicted by the arrow designated 75. However, as shown in FIG. 2 when the device is in a closed position, the end portion 48 of the movable member is wedged or squeezed between a peripheral surface 76 of the sealing disc 38 and the interior wall 78 of the portion 30. Thus, the leg 72 makes sealing engagement with the sealing disc 38 while the leg 74 makes sealing engagement with the body 30 so that leakage is prevented. It is now apparent from what has already been described that the sealing functions are simply, yet effectively handled in a reliable manner. In the case of a wine bottle, the device allows the bottle to be stored in a horizontal position such as in a wine rack.

Figure 4:
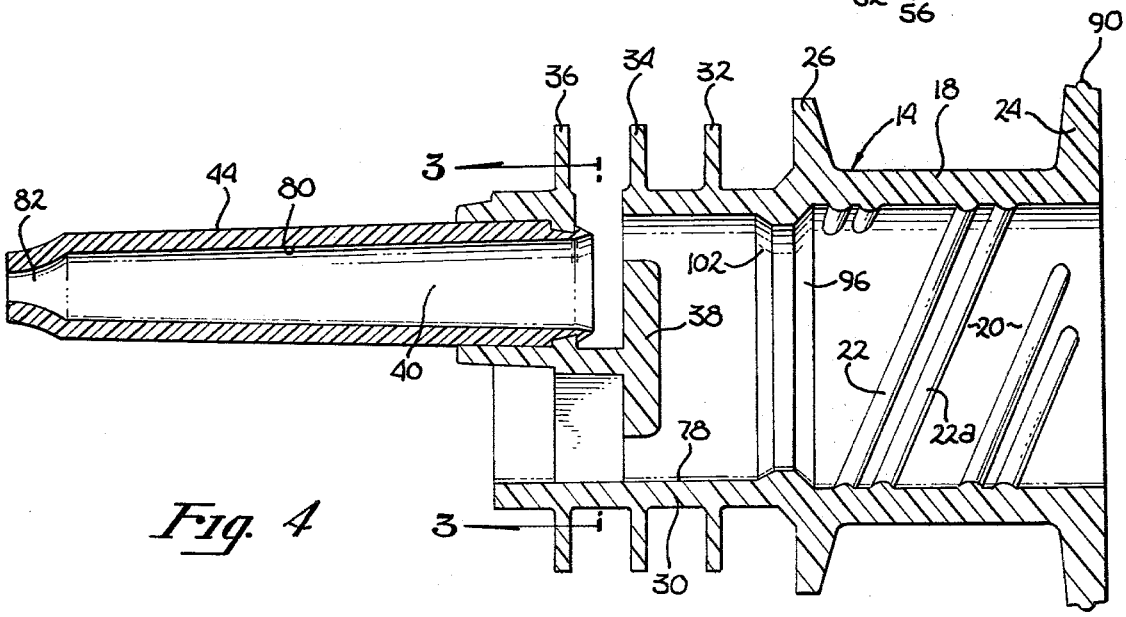
FIG. 4 is a full sectional elevational view taken along line 4—4 of FIG. 3.

In order to facilitate easy opening and closing of the dispensing device each of the members 14 and 16 include mating screw threads 22 and 52. As shown in FIGS. 2 and 4 the screw thread on the interior 20 of the stationary member is doubled so as to form a track 22, **22*a* within which rides the screw thread 52 of the movable member. The threads are pitched to allow opening and closing by rotation of the movable member one half turn (180°). The double thread arrangement provides for more stable, wobble-free operation. However, as shown in FIG. 5, a single thread 22** could also be used if desired.

Figure 3:
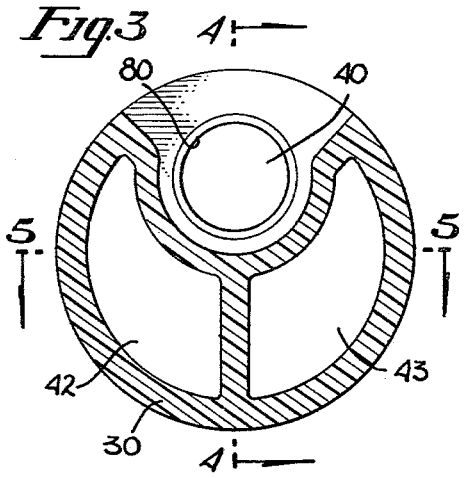
FIG. 3 is a sectional plan view of one member of the dispensing device illustrating the air and content passageways taken along line 3—3 of FIG. 4.

For improved aeration and flow characteristics for liquids such as wine, reference is made to FIG. 4 in conjunction with FIGS. 3 and 7. The flow tube 44 has a tapered or convering interior surface 80 in a direction (toward the left in FIG. 4) away from the remaining portions of the dispensing device; the flow tube terminates in a restricted nozzle portion 82. The nozzle portion causes air entering the container to accelerate so as to achieve a succession of air bubbles as shown in FIG. 7. At the same time, by properly dimensioning the air tube the smoothness and quantity of flow can be controlled, for example to minimize splashing. By way of illustration, the air tube has the following dimensions when sized to compliment a dispensing device to be used with wine bottles. The length of the tube is approximately 1.2 inches, the maximum diameter is approximately 0.18 inches, the minimum diameter of the tube adjacent to the nozzle is 0.13 inches while the minimum nozzle diameter is 0.06 inches.

Enhancing the smooth flow of a liquid such as wine, reference is made to FIGS. 6 and 7 where the funnel shaped surface 54 is shown in more detail. For a wine bottle dispenser the funnel shaped surface has a 45 degree slope which the liquid moves along after passing along the tapered interior surface 50 which is approximately at a 2½ degree slope. The funnel shaped surface terminates at a drip edge 60 which is relatively sharp to prevent undesirable dripping when the bottle is pivoted back into an upright position. In order to achieve a maximum sharp edge the region between the edge and the annular leg is formed into the concave surface 58.

Figure 5:
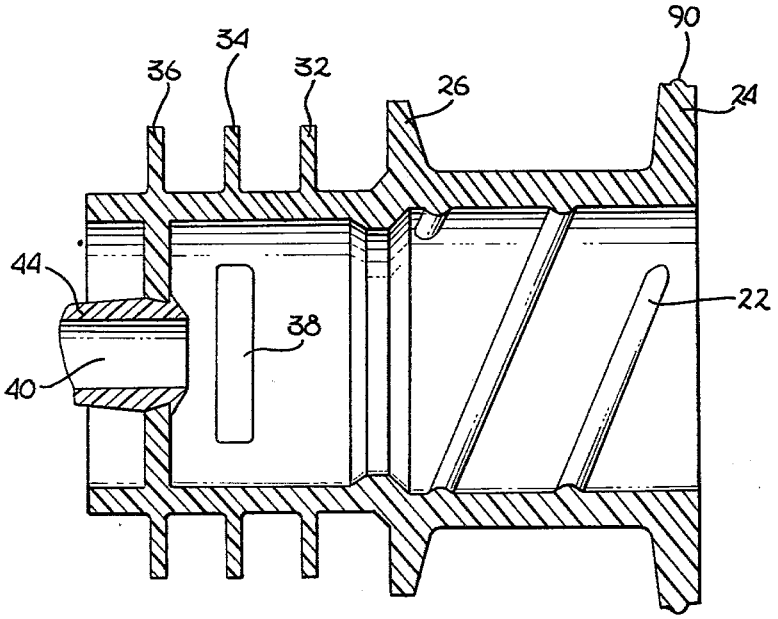
FIG. 5 is a partially broken away sectional elevational view taken along 5—5 of FIG. 3.

Referring now to FIGS. 2 and 5 the upper and lower flanges 24 and 26 are illustrated in more detail as being relatively inflexible as for example when compared to the flanges 32, 34 and 36. The flange 26 acts as an abutment against the container as shown in FIG. 7 so as to limit the distance the dispensing device can be inserted into the container. The upper flange 24 includes an annular projection 90 which is positioned to cooperate with a projection 92, FIG. 6 on the movable member 16.

When the dispensing device is in a closed position as shown in FIG. 2 the annular projections 90 and 92 form an interference fit to "lock" the dispensing device from accidental opening.

As mentioned earlier, the outer gripping surface 62 may be molded with a roughened texture to allow handling by an operator. In addition, to add strength to the device and prevent the annular leg 56 from being compressed a number of radial ribs 94, FIG. 6 are provided spanning the leg and funnel shaped section 53.

Limiting movement of the movable member relative to the stationary member are oblique abutment surface 96, FIG. 4 on the stationary member and oblique abutment surface 98, FIG. 6 on the movable member. These surfaces limit the downward movement of the movable member. To limit upward movement an abutment surface 100, FIG. 6 on the back side of the leg 74 is designed to engage an oblique abutment surface 102, FIG. 4 of the stationary member.

Reference is now made to FIG. 8 which illustrates a modified stationary member **14*a*. In this modification the lower flange 26*a* is integral with an annular leg 108 which has an interior thread 110 for mating with an exterior thread on a container 112. Thus, the discovery device may be used with "screw top" containers. In addition, the container may be pressurized or have an internal bladder or be of flexible material. More importantly, this latter modification which disposes of the air tube allows usage with paste type contents such as artist's paint. For example, the container 112 may be made with flexible walls to allow an operator to squeeze material from its interior past a sealing disc 38*a* and into the interior surface 50*a* of the movable element 16*a*. The space or throat 114 bounded by the tubular shaped surface 50*a* acts as a small cup; thus, a predetermined amount of content may be squeezed into this cup and retained for use. By way of further example, if the content is pasty paint an artist may squeeze an amount equal to the size of the cup 114**; the artist may then use the paint directly by dipping his brush into the cup. Such a technique allows greater control or meeting of the dispensed product, less waste and the elimination of a transfer container. In the case of paint, the ability to use a small amount at a time helps prevent drying from nonuse. It should also be understood that pasty paint will not run out of the throat even if the container is turned to a horizontal position.

In operation, the dispensing device is placed into the container either as an original stopper or as a replacement stopper once the original stopper has been removed. Inserting the dispensing device will cause the flexible flanges 32, 34 and 36 to be pivoted upwardly thereby establishing an excellent seal between the device and the bottle. When it is desired to pour the content of the bottle into a glass an operator merely grips the surface 62, twists the movable member through 180° arc and tilts the bottle over the glass. Air will traverse the device from outside the bottle, past the space 51 through the passageway 40 into the air tube 44 and then into the bottle. Liquid will flow in the reverse direction through the passageways 42 and 43, through the space 51, along the funnel shaped surface 54 and over the edge 60. Another unique feature of the invention is that the device allows a wine bottle to remain in a horizontal position while it is twisted open, hence the bottle does not have to be removed from its rack. When the glass has been filled to the desired amount the operator twists the movable member through a reverse arc of 180° to seal and lock the dispensing device. Because of superior sealing by the device the wine bottle may be stored in a wine rack in a relatively horizontal position without fear that leakage will occur.

If a pasty material is used, an operator merely squeezes the container and fills the space 114. Thereafter, the content may be used directly or transferred to another holder. In either case, the content may be metered by using the space 114 for a measure. It is understood that indicia of volume may be molded into the surface **50*a*** for greater measuring accuracy if desired.

What is claimed is:

1. A dispensing device for a container comprising:

a first member adapted to be disposed in a passageway of a content carrying container, said member having a generally tubular body with two sections, the first section including an internally extending thread and at least one externally extending relatively rigid flange, and the second section including internal means for forming a content passageway and a plurality of external relatively flexible flanges; and a second member adapted to cooperatively operate with said first member, said second member having two sections, a first section being generally tubular and having a smooth internal surface, a sealing end surface and an externally extending thread for engaging the internally extending thread of the first member and being moveable there along; and a second section having a funnel shaped surface contiguous with the smooth internal surface of said first section and an annular leg for forming an operating surface, said second member being moveable between a closed position in which said sealing end surface engages said internal passageway forming means for blocking the flow of content, and an opened position in which said second member is moved along said threads to disengage said sealing end surface and said passageway forming means to allow content flow; and said annular leg and funnel shaped surface intersect to form an edge, said annular leg including an annular concave surface adjoining said edge.

2. A dispensing surface as claimed in claim 1 wherein:

said second section of said second member includes reinforcing ribs between said annular leg and that portion of the member forming said funnel shaped surface.

3. A dispensing device as claimed in claim 1 wherein:

said sealing end surface includes a recess.

4. A dispensing device for a container comprising:

a first member adapted to be disposed in a passageway of a content carrying container, said member having a generally tubular body with two sections, the first section including an internally extending thread and at least one externally extending relatively rigid flange, and the second section including internal means for forming a content passageway and a plurality of external relatively flexible flanges;

a second member adapted to cooperatively operate with said first member, said second member having two sections, a first section being generally tubular and having a smooth internal surface, a sealing end surface and an externally extending thread for engaging the internally extending thread of the first member and being moveable there along, and a second section having a funnel shaped surface contiguous with the smooth internal surface of said first section and an annular leg for forming an operating surface, said second member being moveable between a closed position in which said sealing end surface engages said internal passageway forming means for blocking the flow of content, and an opened position in which said second member is moved along said threads to disengage said sealing end surface and said passageway forming means to allow content flow;

said annular leg of said second member includes an inwardly directed projection; and said flange of said first member includes an outwardly directed projection whereby when said members are in said closed position said projections abut one another.

5. A dispensing device as claimed in claim 4 wherein said first member includes an airflow tube connected to said second section and positioned to extend into said container;

said passage forming means includes a centrally disposed disc having an annular peripheral surface, said annular peripheral surface for engaging a portion of the smooth internal surface of said second member when in said closed position, and three passageways, two for content such as a liquid and one for air disposed about said disc, said air passageway communicating with said air flow tube;

said annular leg and funnel shaped surface intersect to form an edge, said annular leg including an annular concave surface adjoining said edge; and said sealing end surface includes a recess.

* * * * *